US006935579B1

(12) United States Patent
Lindsey

(10) Patent No.: US 6,935,579 B1
(45) Date of Patent: Aug. 30, 2005

(54) DUAL SPRAY CLEANING APPARATUS

(76) Inventor: Jimmie L. Lindsey, P.O. Box 9761, Jackson, MS (US) 39286

( * ) Notice: Subject to any disclaimer, the term of this patent is extended or adjusted under 35 U.S.C. 154(b) by 0 days.

(21) Appl. No.: 10/753,036

(22) Filed: Jan. 7, 2004

(51) Int. Cl.[7] ..... B05B 9/08
(52) U.S. Cl. ..... 239/530; 239/532; 119/604
(58) Field of Search ..... 239/530, 532; 119/604, 665, 608; 4/567, 568, 569, 615; 401/130, 128, 126, 263, 270, 285

(56) References Cited

U.S. PATENT DOCUMENTS

| | | | | |
|---|---|---|---|---|
| 4,022,382 A | | 5/1977 | Engdahl, Jr. | 239/287 |
| 4,095,746 A | | 6/1978 | Anderberg et al. | 239/287 |
| 4,879,784 A | * | 11/1989 | Shero | 15/322 |
| 4,930,706 A | | 6/1990 | Merlin | 239/754 |
| 5,271,682 A | | 12/1993 | Realdon | 401/37 |
| 5,364,198 A | * | 11/1994 | Skenderi | 401/138 |
| 6,283,656 B1 | * | 9/2001 | Jiang | 401/1 |
| 6,419,415 B1 | | 7/2002 | Vosbikian et al. | 401/289 |
| 6,547,469 B2 | * | 4/2003 | Vito | 401/138 |
| 6,553,941 B2 | * | 4/2003 | Porter | 119/665 |
| 6,647,585 B1 | * | 11/2003 | Robinson | 15/322 |

* cited by examiner

*Primary Examiner*—David A. Scherbel
*Assistant Examiner*—Thach H. Bui
(74) *Attorney, Agent, or Firm*—Sturm & Fix LLP

(57) ABSTRACT

A dual spray cleaning apparatus (10) for sweeping, degreasing, wiping, and drying a waterproof floor surface wherein, the apparatus (10) includes a generally T-shaped spray wand member (30) having a primary spray gun member (34) formed on one end wherein, the other end of the spray wand member (30) has a cross arm (32) provided with a plurality of spray nozzles (33) wherein, the cross arm (32) is also operatively connected to an elongated wiper blade member (23); and wherein, the primary spray gun member (34) is releasably associated with an auxiliary single nozzle spray gun member (40) having an elongated length of hose (42) that is operatively connected to a portion (36) of the primary spray gun member (34).

7 Claims, 2 Drawing Sheets

DUAL SPRAY CLEANING APPARATUS

CROSS REFERENCE TO RELATED APPLICATIONS

Not applicable.

BACKGROUND OF THE INVENTION

1. Field of the Invention

The present invention relates to the field of combined spraying sweeping apparatus in general and in particular to a dual spray arrangement associated with a drying squeegee.

2. Description of Related Art

As can be seen by reference to the following U.S. Pat. Nos. 5,271,682; 6,419,415; 4,930,706; 4,095,746, and 4,022,382, the prior art is replete with myriad and diverse cleaning apparatus that employ high pressure sprays both by themselves and in concert with other cleaning implements.

While all of the aforementioned prior art constructions are more than adequate for the basic purpose and function for which they have been specifically designed, they are uniformly deficient with respect to their failure to provide a simple, efficient, and practical dual spray arrangement for cleaning a floor surface in combination with a squeegee style wiper blade for wiping the surface dry.

Currently in the restaurant business alone two or three employees are tasked with cleaning up the kitchen floors at the close of business wherein, the first employee sweeps the floor and applies a de-greaser, the second employee washes the floor down with a hose and the third employee follows up with a mop or squeegee to dry the floor surface and this is only one example of environments wherein, more than one employee is required to clean a floor surface.

As a consequence of the foregoing situation, there has existed a longstanding need in many industries for a new and improved combined dual spray and squeegee apparatus that can be utilized by a single employee to sweep, de-grease, wipe, and dry a floor surface with a single implement resulting in savings in both manpower and in operating costs; and, the provision of such an apparatus is the stated objective of the present invention.

BRIEF SUMMARY OF THE INVENTION

Briefly stated, the dual spray cleaning apparatus that forms the basis of the present invention comprises in general a squeegee unit, a primary spray unit and an auxiliary spray unit that cooperate with one another to sweep, de-grease, wipe and dry a hard waterproof floor surface.

As will be explained in greater detail further on in the specification, the squeegee unit comprises a T-shaped handle member the distal end of which is provided with an elongated squeegee or wiper blade that is affixed to the cross-arm of the handle member.

In addition, the stem and cross arms of the handle member are operatively connected to the primary spray unit which includes a T-shaped spray wand wherein, the spray wand cross-arm is provided with a plurality of downwardly directed spray nozzles and the proximal end of the elongated stem of the spray wand is provided with a main spray gun member having a first trigger that controls the delivery of water and/or soap, de-greaser or other cleaning fluids to the spray nozzles from a remote fluid supply.

Furthermore, the auxiliary spray unit includes an auxiliary single nozzle spray gun member fluidly coupled upstream of the main spray gun member via an elongated flexible hose that allows the focused delivery of hot water, de-greaser, etc., into those areas that are not accessible to the squeegee mounted spray array.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
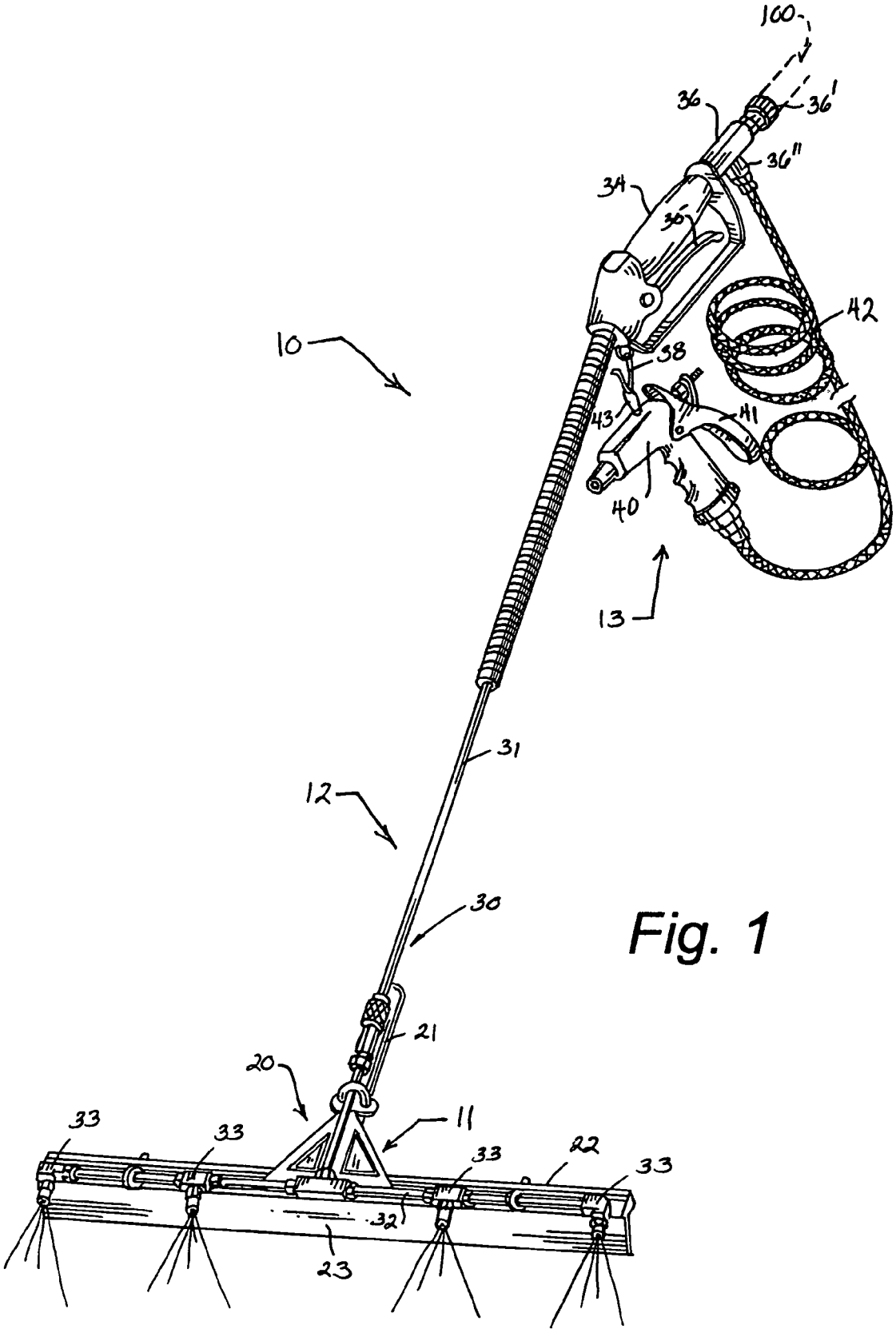
FIG. 1 is a perspective view of the dual spray cleaning apparatus that forms the basis of the present invention.

As can be seen by reference to the drawings, and in particular to FIG. 1, the dual spray cleaning apparatus that forms the basis of the present invention is designated generally by the reference number 10. The apparatus 10 comprises in general a squeegee unit 11, a primary spray unit 12 and an auxiliary spray unit 13. These units will now be described in seriatim fashion.

As can best be appreciated by reference to FIGS. 1 and 3, the squeegee unit 11 comprises a generally T-shaped handle member 20 having a stem 21 and an elongated cross-arm 22 provided with a downwardly depending elongated wiper blade member 23 the purpose and function of which will be described in greater detail further on in the specification.

Figure 2:
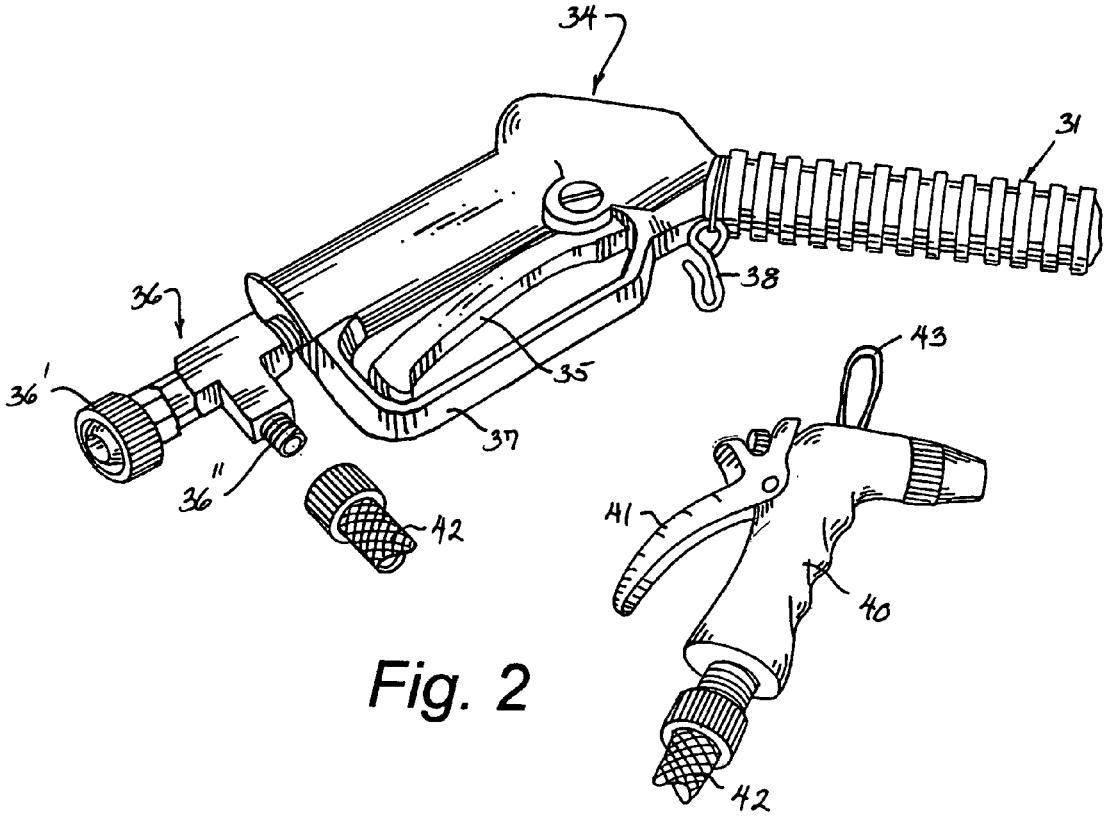
FIG. 2 is an enlarged perspective view of the primary and auxiliary spray gun members; and, FIG. 3 is an isolated detail view of the squeegee unit and the nozzle array of the primary spray unit.
Figure 3:
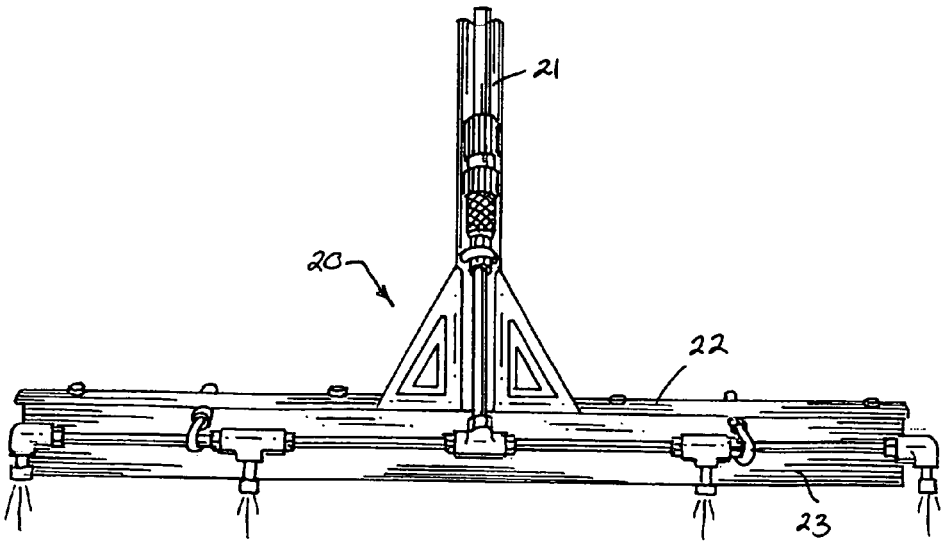

Turning now to FIGS. 1 through 3, it can be seen that the primary spray unit 12 comprises a generally T-shaped spray wand member 30 having an elongated hollow shaft 31 the distal end of which is connected to the squeegee unit 11 and terminates in a cross-arm 32 provided with a plurality of downwardly directed spaced spay nozzles 33 the spray jets of which are focused forwardly of the wiper blade member 23.

In addition, the proximal end of the spray wand shaft 31 is coupled to a primary spray gun member 34 having a trigger 35 and further provided with a branched fluid coupling 36 having a proximal end 36' adapted to be operatively connected to a high pressure hose 100 that may deliver hot water, de-greaser, etc., through the coupling and further having an intermediate portion 36" that is adapted to be fluidly coupled to the auxiliary spray unit 13 as will be explained presently.

As can best be seen by reference to FIGS. 1 and 2, the auxiliary spray unit 13 comprises a single nozzle auxiliary spray gun member 40 provided with a trigger 41 and having an elongated length of coiled hose 42 that operatively connects the auxiliary spray gun member 40 to the branched fluid coupling 36 in a well recognized fashion.

In addition, as is best depicted in FIG. 2, the primary spray gun member 34 is provided with a trigger guard 37 having a hook element 38 and the auxiliary spray gun member 40 may be releasably suspended from the primary spray gun member 34 when the auxiliary spray gun member 40 is not being actively deployed.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A spray cleaning apparatus comprising a primary spray unit including a generally T-shaped spray wand member including a hollow shaft having one end connected to a primary spray gun member wherein, the other end of the hollow shaft terminates in a cross arm provided with a plurality of downwardly angled forwardly directed spray nozzles;

a squeegee unit including an elongated wiper blade member that is operatively connected to the cross arm of the spray wand member; and an auxiliary spray unit disposed in fluid communication with the primary spray unit wherein the auxiliary spray unit includes a single nozzle spray gun member provided with an elongated length of hose which is operatively connected to a portion of the primary spray unit.

2. The apparatus as in claim 1; wherein, the primary spray gun member is further provided with a branched fluid coupling adapted to be connected to both a high pressure hose as well as the elongated length of hose that is connected to said single nozzle spray gun member.

3. The apparatus as in claim 2 further including means for releasably connecting the single nozzle spray gun member to a portion of the primary spray gun member.

4. The apparatus as in claim 1; wherein, the squeegee unit further includes a generally T-shaped handle member wherein, the shaft of the handle member is connected to the shaft of the spray wand member and the cross arm of the handle member is connected to the cross arm of the spray wand member.

5. The apparatus as in claim 4; wherein, the wiper blade member is fixedly connected to the cross arm of said handle member.

6. The apparatus as in claim 3; wherein, the squeegee unit further includes a generally T-shaped handle member wherein, the shaft of the handle member is connected to the shaft of the spray wand member and the cross arm of the handle member is connected to the cross arm of the spray wand member.

7. The apparatus as in claim 6; wherein, the wiper blade member is fixedly connected to the cross arm of said handle member.

* * * * *